US006182826B1

(12) United States Patent
Slepian

(10) Patent No.: US 6,182,826 B1
(45) Date of Patent: Feb. 6, 2001

(54) INFLATABLE PROTECTIVE COVER FOR GOLF CLUB BAGS

(76) Inventor: Harvey A. Slepian, 1426 W. Daytona, Peoria, IL (US) 61615

( * ) Notice: Under 35 U.S.C. 154(b), the term of this patent shall be extended for 0 days.

(21) Appl. No.: 09/290,293

(22) Filed: Apr. 13, 1999

(51) Int. Cl.[7] ..... A63B 55/00

(52) U.S. Cl. ..... 206/315.4; 206/522; 383/3; 150/159

(58) Field of Search ..... 206/315.4, 315.6, 206/522; 150/159; 383/3

(56) References Cited

U.S. PATENT DOCUMENTS

| | | | | |
|---|---|---|---|---|
| 2,672,902 | | 3/1954 | Prager . | |
| 2,704,563 | | 3/1955 | Henrich . | |
| 2,824,589 | | 2/1958 | Neisler, Jr. et al. . | |
| 3,251,075 | * | 5/1966 | Saltness et al. | 383/3 X |
| 4,044,867 | | 8/1977 | Fisher . | |
| 4,164,970 | | 8/1979 | Jordan . | |
| 4,174,747 | | 11/1979 | Boles . | |
| 4,573,202 | * | 2/1986 | Lee | 206/522 X |
| 4,574,953 | | 3/1986 | Garbuzov . | |
| 4,826,329 | * | 5/1989 | Bellini | 206/522 X |
| 5,419,473 | | 5/1995 | Lumar . | |
| 5,421,454 | * | 6/1995 | Chern | 206/315.6 |
| 5,490,594 | | 2/1996 | Rupe . | |
| 5,624,035 | * | 4/1997 | Kim | 206/522 |
| 5,704,475 | * | 1/1998 | Jack | 206/315.4 |
| 5,819,829 | * | 10/1998 | Matthews | 206/315.4 X |

FOREIGN PATENT DOCUMENTS 226654 12/1957 (AU) .

2 103 938 3/1983 (GB) .

* cited by examiner

*Primary Examiner*—Allan N. Shoap
*Assistant Examiner*—Tri M. Mai
(74) *Attorney, Agent, or Firm*—Haynes and Boone, LLP

(57) ABSTRACT

An inflatable protective cover for golf club bags includes first, second, third and fourth flexible walls. An inner side surface of a lower part of the first wall frictionally engages the golf club bag while an upper part thereof covers an opening in the golf club bag and the portion of any clubs projecting from the opening. A lower part of the second flexible wall is sealingly attached to the lower part of the first wall while an upper part thereof overlays the upper part of the first wall to form a first, normally inflated, air bladder therebetween. Similarly, a lower part of the third flexible wall is sealingly attached to the lower part of the second wall while an upper part thereof to form a second, normally deflated, air bladder therebetween. An air supply system comprised of a pump bulb and a flexible air conduit in communication with the first air bladder provides a quantity of air to the protective cover to inflate the first air bladder. Excess pressure conditions within the first air bladder are relieved by a flow of a portion of the quantity of air, through a pressure relief valve, into the second air bladder. In this manner, excess pressure conditions within the first air bladder may be relieved without removing air from the protective cover. When not in use, the pump valve is storable in a space formed by a fourth flexible wall having a lower part attached to the lower part of the third wall and an upper part which overlays the upper part of the third wall. The storage space is accessible through an aperture formed in the fourth wall.

29 Claims, 1 Drawing Sheet

INFLATABLE PROTECTIVE COVER FOR GOLF CLUB BAGS

TECHNICAL FIELD

The invention relates generally to protective covers for golf club bags and, more particularly, to a multi-chambered inflatable protective cover which enhances protection of golf clubs and other items carried in a golf club bag covered thereby.

BACKGROUND OF THE INVENTION

Various types of protective covers which protect golf clubs have been disclosed. Many such covers protect a golf club by fitting over a head portion thereof. While such conventional covers constructed of a layer of cloth, canvas or other similar material can protect the golf clubs from damage which may result when a golf club bag holding the clubs is jostled while being carried, addition protection is needed when the golf club bag and clubs are transported greater distances, for example, by an airplane or other motorized conveyance. When a golf club bag is used to transport golf clubs over long distances, a protective cover which generally resembles a "hood" is often used to protect and retain the golf clubs within the bag. See, for example, U.S. Pat. No. 2,704,563 to Henrich and U.S. Pat. No. 5,490,594 to Rupe. Like golf club covers, protective covers for the golf club bag are typically constructed of cloth, canvas or other similar material.

Typically, the protective cover is positioned over the ends of the clubs protruding from a generally cylindrical opening located at the top of the golf club bag and secured firmly to the sides of the golf club bag. In this manner, the clubs are retained within the bag and will not slid out of the bag if dropped or thrown, for example, when loaded onto a conveyor system which transports the golf clubs to a baggage claim area within an airport. However, while protective covers will often successfully retain golf clubs within a golf club bag, they provide little, if any, protection from damage due to sharp blows or strikes.

U.S. Pat. No. 5,704,475 to Jack discloses an inflatable protective cover suitable for attachment to a golf club bag. While the inflatable protective cover disclosed in Jack will likely provide greater protection than prior, non-inflatable, protective covers, it is contemplated that the protective cover disclosed in Jack is susceptible to unnecessarily high failure rates under certain conditions. As those conditions most often arise while the golf club bag is being transported, the inflatable protective cover will most likely fail when it is needed most. More specifically, a conventionally designed inflatable protective cover is susceptible to changes in air pressure within the inflatable air bladder, relative to the air pressure outside the bladder. For example, a sudden drop in outside pressure, for example, due to an altitude change, can cause the protective cover incorporating the air bladder to literally "pop off" the golf club bag to which it is attached. Increases in temperature which cause the air within the inflatable air bladder to expand may also have the same effect. Finally, exterior objects, when pressed against the inflatable protective cover are also cause for concern. For example, if the golf club bag is stored under cramped conditions where the attached inflatable protective cover is pressed against a wall or other items being stored, a compressive force applied to the protective cover may cause air within one part of the inflatable bladder to be forced into another part of the bladder. The increased pressure within one portion of the air bladder may cause it to deform in a manner which would cause the protective cover to detach from the golf club bag or, under severe compressive compressions, to result in a decompressive structural failure of the inflatable air bladder itself.

Therefore, what is needed is an inflatable protective cover for golf club bags which is specially designed to handle changes in air pressure. It is, therefore, the object of this invention to provide such an inflatable protective cover for golf club bags.

SUMMARY OF THE INVENTION

In one embodiment, the present invention is of a protective cover comprised of an inflatable body portion and an attachment member. When the attachment member biases the inflatable body portion into frictional engagement with a side surface of a golf club bag, the inflatable body portion, which is secured to the attachment member, covers both an opening in the golf club bag as well as a portion of each golf club which projects from the opening. The inflatable body portion includes a first, inner, bladder and a second, outer, bladder generally coextensive with the first bladder. In one aspect thereof, the first bladder communicates with the second bladder via a pressure relief valve. When inflated, the first bladder protects the golf clubs in the golf club bag from outside forces. If, however, an excess pressure condition develops within the first bladder, a flow of air into the second bladder relieves the excess pressure condition within the first bladder without reducing the total amount of air maintained within the inflatable body portion. In another aspect, an air supply system provides air to the interior of the first bladder via an inlet/outlet valve in communication with the interior of the first bladder. The air supply system may be configured as a pump bulb coupled to the inlet/outlet valve by a flexible tube.

In a further aspect of this embodiment of the invention, the protective cover may include an outer cover member covering the inflatable body portion and secured to the inflatable body portion and the attachment member. In this aspect, the pump bulb may be positioned between an outer side surface of the inflatable body portion and an inner side surface of outer cover member by inserting the pump bulb through an aperture formed in the outer cover member.

In still further aspects of this embodiment of the invention, a primary air release valve, coupled to the air supply system, provides an exit path for air in the interior of the first bladder while a secondary air release valve provides an exit path for air in the interior of the second bladder. The primary air release valve may be coupled to the flexible tube of the air supply system while the secondary air release valve is in communication with the interior of the second bladder.

In still other further aspects of this embodiment of the invention, the attachment member includes a securing strap, coupled to the attachment member, for biasing the inflatable body portion into frictional engagement with the golf club bag. The interior side surface of the securing strap and the exterior side surface of the attachment member may have complementary hook and pile surfaces for removable engagement therebetween.

In another embodiment, the present invention is of a protective cover, suitable for attachment to a golf club bag having a golf club receiving opening formed along a top side thereof, which includes first, second and third flexible walls. A lower part of the first wall frictionally engages the golf club bag while an upper part thereof covers the opening in the golf club bag. A lower part of the second flexible wall is sealingly attached to the lower part of the first wall while an upper part thereof overlays the upper part of the first wall to form a first, normally inflated, air bladder therebetween. Similarly, a lower part of the third flexible wall is sealingly attached to the lower part of the second wall while an upper part thereof to form a second, normally deflated, air bladder therebetween. An air supply system in communication with the first air bladder provides a quantity of air to the protective cover by inflating the first air bladder with the quantity of air. Excess pressure conditions in the first air bladder are relieved by a flow of a portion of the quantity of air, through a pressure relief valve, into the second air bladder. In this manner, excess pressure conditions within the first air bladder may be relieved without removing air from the protective cover.

In one aspect of this embodiment of the invention, the air supply system includes an air conduit having one end in communication with the first air bladder and a second end in communication with an air outlet of an air pump which, in a further aspect thereof, may be a pump bulb. In another aspect, a storage space is formed by a fourth flexible wall having a lower part attached to the lower part of the third wall and an upper part which overlays the upper part of the third wall. The storage space is accessible through an aperture formed in the fourth wall and may be used to store the air pump therein. In still other aspects thereof, primary and secondary air release valves provide exit paths for the quantity of air held by the first bladder and the portion of the quantity of air removed from the first bladder and transferred to the second bladder, respectively. The primary and secondary release valves are actuatable valves in respective communication with the first and second air bladders.

In still another embodiment, the present invention is directed to a golf club transportation and protection system which includes a golf club bag and a protective cover which provides a protective cushion for golf clubs held within an interior space of the golf club bag by retaining a quantity of air therein.

The protective cover frictionally engages a sidewall of the golf club bag and covers an opening from which a portion of the golf clubs project. A first, normally inflated, air bladder forming part of the protective cover is inflated by the quantity of air supplied thereto by an air supply system in communication therewith. Excess pressure conditions within the first air bladder are relieved without the removal of air from the protective cover by the transfer of a portion of the quantity of air to a second, normally deflated, air bladder, also forming part of the protective cover, in communication with the first air bladder via a pressure relief valve.

BRIEF DESCRIPTION OF THE DRAWINGS

The invention will be better understood and its numerous objects and advantages will become apparent to those skilled in the art by reference to the following drawings in which.

DETAILED DESCRIPTION

Figure 1:
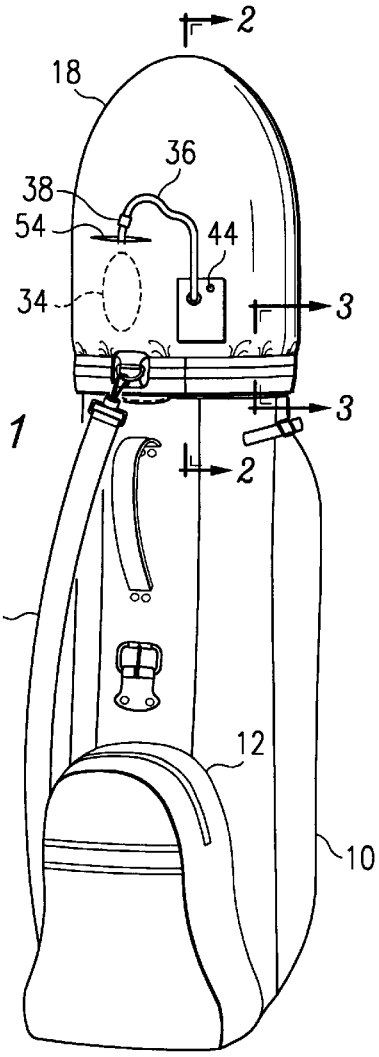
FIG. 1 is a perspective view of a golf club bag having an inflatable protective cover constructed in accordance with the teachings of the present invention removably attached thereto.

Referring first to FIG. 1, a conventionally configured golf club bag 10 may now be seen. As is well known in the art, the golf club bag 10 includes at least one closeable compartment 12 for holding golfing supplies such as balls, tees and the like and a strap 14 to assist golfers when carrying, lifting or otherwise transporting the golf club bag 10 between first and second locations.

While not visible in FIG. 1, the golf club bag 10 also includes a generally cylindrical interior area 16, defined by a sidewall 10*a* and a top edge surface 10*b* of the golf club bag 10, for holding golf clubs and other types of golf equipment generally characterized by an elongated cylindrical shaft. Typically, a support structure is mounted within the interior area 16 of the golf club bag 10, thereby sectioning the interior area 16 into a number of subsections, each having a cross-sectional area considerably smaller than the cross-sectional area of the golf club bag 10 itself. As a result, golf clubs placed inside the golf club bag 10 will be less susceptible to lateral movement and/or striking other clubs when the golf club bag 10 is being carried. A portion of each such golf club will, however, tend to outwardly project beyond the top edge surface 10*b* of the golf club bag 10. By way of example, one such golf club 11 is shown in phantom in FIG. 2. Of course, while a single golf club 11 is shown in FIG. 2, a golf club bag 10 typically holds on the order of about 12 golf clubs of various designs.

Figure 3:
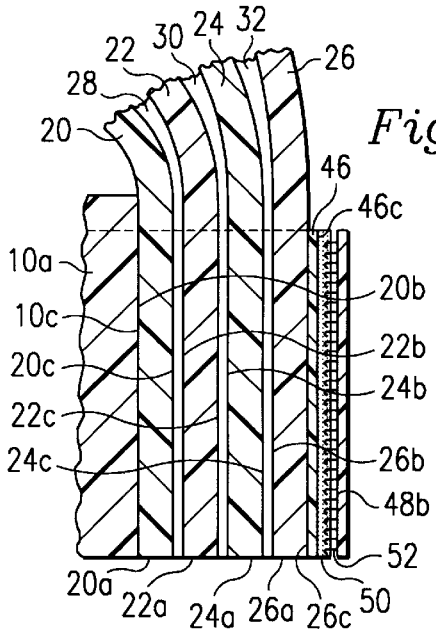
FIG. 3 is a second, enlarged, partial cross-sectional view of the inflatable cover of FIG. 1 taken along lines 3—3 thereof.
Figure 2:
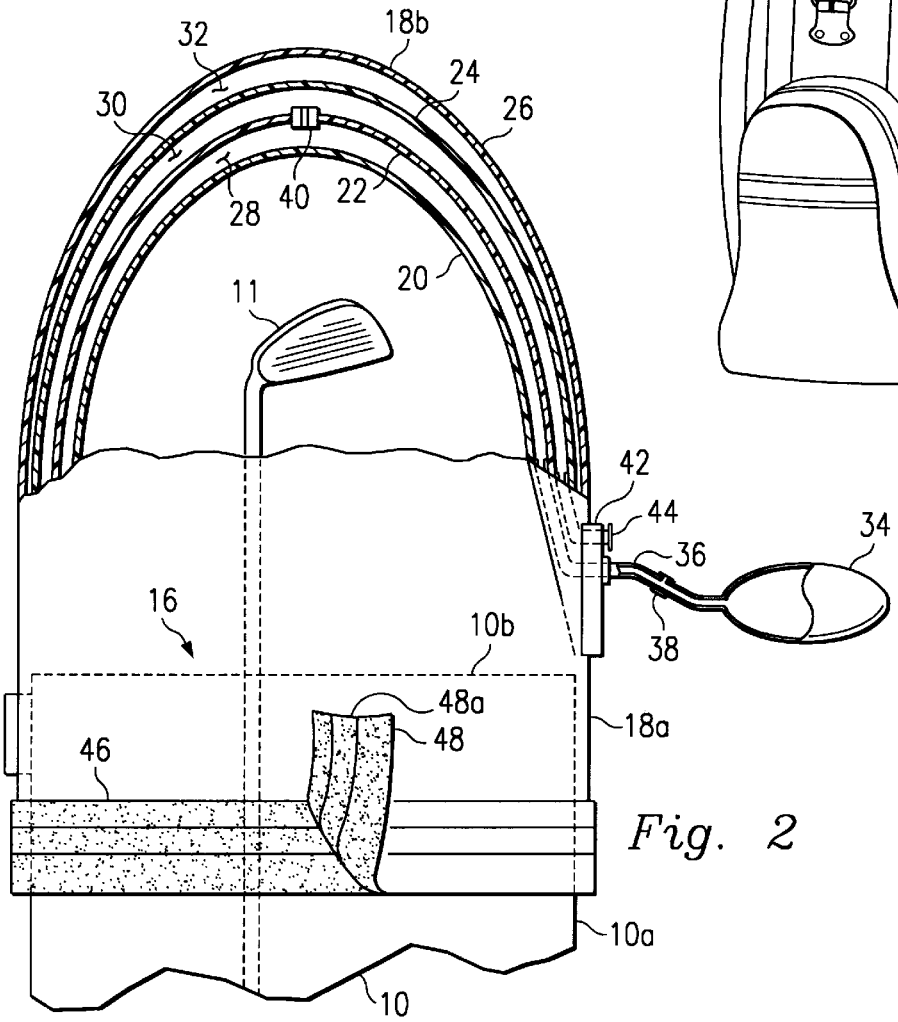
FIG. 2 is a first partial cross-sectional, partial schematic view of the inflatable cover of FIG. 1 taken along lines 2—2 thereof.

Referring collectively to FIGS. 1–3, a protective cover 18, constructed in accordance with the teachings of the present invention, will now be described in greater detail. As may be seen in both FIGS. 1 and 2, the protective cover 18 includes a lower part 18*a* which frictionally engages an exterior side surface of the sidewall 10*a* along a selected length which extends from the top edge surface 10*b* and an upper part 18*b* which covers the opening, defined by the top edge surface 10*b*, to the interior area 16 which receives the golf clubs 11, and that portion of any golf clubs 11 which project upwardly therefrom. Of course, the lower part 18*a* may be attached to the sidewall 10*a* of the golf club bag 10 using a variety of techniques. For example, complementary snaps mounted affixed to the protective cover 18 and the golf club bag 10 may be used to mount the protective cover 18 to the golf club bag 10. As will be more fully described below, the protective cover 18 acts to: (1) retain the golf clubs 11 within the interior area 16 of the golf club bag 10 and prevent them from falling out if the golf club 10 is dropped, tossed or otherwise handled roughly while being transported between locations; and (2) prevent the portion of the golf clubs 11 retained within the interior area 16 which project upwardly therefrom from being damaged by sharp blows or other external forces which may occur while the golf club bag 10 is being transported, for example, if the golf club bag 10 is tossed against a bulkhead of the cargo area of an airplane.

The protective cover 18 is comprised of first, second, third and fourth walls 20, 22, 24 and 26, each formed of a flexible material. Preferable, the first, second and third walls 20, 22 and 24 are formed of an impermeable resilient material suitable for use as part of an inflatable bladder. The fourth wall 26, on the other hand, may be made of a wider array of materials, including a number of fabrics used for rain gear or other outerwear. For example, the fourth wall 26 may be formed using a section of cloth, preferably dyed to match the color of the golf club bag 10. Each of the first, second, third and fourth walls 20, 22, 24 and 26 include a lower part and an upper part. For the first wall 20, the lower part circumferentially overlays the sidewall 10*a* of the golf club bag 10 while the upper part covers the opening to the interior area 16 and the projecting portion of the golf clubs 11. For the second, third and fourth walls 22, 24 and 26, the lower part circumferentially overlays the lower part of the first, second and third walls 20, 22 and 24, respectively. Similarly, the upper part of the second, third and fourth walls 22, 24 and 26 overlays the upper part of the first, second and third walls 20, 22 and 24.

More specifically, as best seen in FIG. 3, the lower part of the first wall 20 terminates at a lower peripheral edge 20*a*. When the protective cover 18 is fitted over the golf club bag 10, an interior side surface 20*b* of the first wall 20 frictionally engages an exterior side surface 10*c* of the sidewall 10*a* of the golf club bag 10 along the entire circumference thereof to mount the protective cover 18 onto the golf club bag 10. An interior side surface 22*b* of a portion of the lower part of the second wall 22 which terminates at a lower peripheral edge 22*a* is fixedly attached to an exterior side surface 20*c* of the first wall 20 along the entire circumference thereof. The first and second walls 20 and 22 may be fixedly attached to each other by any suitable conventional technique, for example, heat sealing, which would form an air-tight seal therebetween. As the first and second walls 20 and 22 are only fixedly attached to each other along a portion of the respective lower parts thereof, a first air bladder 28 is formed between the un-attached portions of the outer side surface 20*c* of the first wall 20 and the inner side surface 22*b* of the second wall 22.

Similarly, an interior side surface 24*b* of a portion of the lower part of the third wall 24 which terminates at a lower peripheral edge 24*a* is fixedly attached to an exterior side surface 22*c* of the second wall 20 along the entire circumference thereof. As before, the second and third walls 22 and 24 are fixedly attached to each other by a conventional technique such as heat sealing which would form an air-tight seal therebetween. As the second and third walls 22 and 24 are only fixedly attached to each other along a portion of the respective lower parts thereof, a second air bladder 30 is formed between the un-attached portions of the outer side surface 22*c* of the second wall 22 and the inner side surface 24*b* of the third wall 24.

Finally, an interior side surface 26*b* of a portion of the lower part of the fourth wall 26 which terminates at a lower peripheral edge 26*a* is fixedly attached to an exterior side surface 24*c* of the third wall 24 along the entire circumference thereof. The third and fourth walls 24 and 26 are fixedly attached to each other. As before, a heat sealing technique would be suitable. However, unlike the seals between the first and second walls 20 and 22 and between the second and third walls 22 and 24, an air-tight seal is not necessary. Accordingly, a wider array of attachment techniques are available. As the third and fourth walls 24 and 26 are only fixedly attached to each other along a portion of the respective lower parts thereof, a space 32 is formed between the unattached portions of the outer side surface 24*c* of the third wall 24 and the inner side surface 26*b* of the fourth wall 26.

While a specific configuration of the securement of first, second, third and fourth walls 20, 22, 24 and 26 has been disclosed herein, it should be clearly understood that the disclosed embodiment is by example only and that the invention encompasses various configurations other than those described and illustrated herein. For example, as disclosed herein, the first, second, third and fourth walls are secured to each other from their respective lower peripheral edges 20*a*, 22*a*, 24*a* and 26*a* to a point along the lower part of the walls 20, 22, 24 and 26. However, the sealed portions of the walls 20, 22, 24 and 26 may be of varied length and need not necessarily extend to the respective peripheral edges 20*a*, 22*a*, 24*a* and 26*a*.

Furthermore, as disclosed herein, the first, second, third and fourth walls 20, 22, 24 and 26 separate to define the first and second air bladders 28 and 30 and the space 32 at a point along the lower part of the protective cover 18 which is below the top edge surface 10*b* of the golf club bag 10 when the protective cover 18 is mounted thereto. However, the precise location of the point of separation of the first, second, third and fourth walls 20, 22, 24 and 26, relative to the golf club bag 10 may be readily varied. Indeed, the point of separation may be changed simply by how far the lower part of the protective cover 18 is pulled over the golf club bag 10. Generally, however, it is preferable that the point of separation be below the edge side surface 10*b*.

As further disclosed herein, the first and second bladders 28 and 30 and the space 32 start along a common line generally parallel to, and spaced above, the peripheral edges 20*a*, 22*a*, 24*a* and 26*a*. Alternately, it is contemplated that the first bladder 28, the second bladder 30 and the space 32 may be arranged in a "staggered" configuration in which the first bladder 28 begins lower than the second bladder 28 which, in turn, begins below the space 32. Such a configuration may simplify the task of forming air inlet and/or air outlet conduits to the first and second bladders 28 and 30.

The seals between the first and second walls 20 and 22, the second and third walls 22 and 24, and the third and fourth walls 24 and 26 are all shown to be of roughly the same length. Again, it is fully contemplated that the seals instead be formed to have different lengths. Furthermore, the illustrated configuration is "layered", i.e., the second wall 22 is sandwiched between the first and third walls 20 and 24 and the third wall 24 is sandwiched between the second and fourth walls 22 and 26. Again, this is but one embodiment of the invention. For example, it is contemplated that the first and fourth walls 20 and 26 may be longer than the second and third walls 22 and 24 and the fourth wall 26 may be fixedly attached directly to the first wall 20.

As may be best seen in FIG. 2, positioned outside of the protective cover 18 is a pump bulb 34. The pump bulb 34 is in communication with the first air bladder 28 via a flexible conduit 36 having a first end in communication with the pump bulb 34 and a second end in communication with the first air bladder 28. As schematically shown in phantom in FIG. 2, the flexible conduit 36 extends through an aperture formed in the protective cover 18 which extends to the first air bladder 18. Alternately, the flexible tube 36 may terminate at the exterior side surface of the protective cover 18 where it is communication with an aperture which extends to the first air bladder 28. If desired, an air release valve 38 may be provided along the flexible conduit 36. The air release valve 38 is normally closed but may be opened to provided an exit path for air held within the first air bladder 28.

Access to the first air bladder 18 may be achieved in a variety of techniques. For example, the seal between the second and third walls 22 and 24 may extend upwardly considerably further than the seal between the first and second walls 20 and 22. The aperture (either with or without the accompanying flexible tubing) may then extend through the fourth, third and second walls 26, 24 and 22 and beneath the second air bladder 30 and open into the first air bladder 28. Alternately, the aperture in which the flexible tub 36 is inserted can extend through the fourth wall 26, the space 32, the third wall 24, the second air bladder 30 and the second wall 22. In this configuration, however, the points of entry into and exit out of the second air bladder 30 must be sealed to prevent the leakage of air out of the first air bladder 28 and into the second air bladder 30 and out of the second air bladder 30 and into the atmosphere.

A pressure relief valve 40 is mounted within the second wall 22 which separates the first and second air bladders 28 and 30. For example, an aperture (not shown) may be formed in the second wall 22 and the pressure relief valve 40 insertably mounted in the aperture. The pressure relief valve is a one-way valve which permits the flow of air from the first air bladder 28 to the second air bladder 30 under certain conditions but will not permit the flow of air from the second air bladder 30 to the first air bladder 28. More specifically, air will flow from the first air bladder 28 to the second air bladder 30 when the air pressure within the first air bladder 28 exceeds a pre-selected threshold value. While the particular air pressure which will open the pressure relief valve 40 to initiate the flow of air out of the first air bladder 28 and into the second air bladder 30 will vary depending on a variety of factors such as the elasticity of the first and second walls 20 and 22, generally, it is preferred that the pressure relief valve open whenever the pressure within the first bladder 28 is a pre-selected level, for example, 2 p.s.i., above a pressure level deemed to be the "fully inflated" pressure level, for example, 25 p.s.i., for the first air bladder 28. Of course, while the fully inflated pressure level may be manually detected, for example, when the first air bladder 28 feels firm to the touch and resists compression when grasped, it is fully contemplated that a pressure level indicator may be incorporated into the air supply system. For example, a pressure gauge may be built into the flexible conduit 36. Alternately, a "pop-up" indicator of a full inflation condition may be built into the flexible conduit 36.

If desired, the protective cover 18 may further include a secondary air release valve 44 which provides an exit path for air in the second air bladder 30. By providing an air exit path for the second air bladder 30, air transferred to the second air bladder 30 can be removed, for example, prior to storage of the protective cover 18. Again, it is contemplated that the air exit path for the second air bladder 30 may be variously configured. For example, an aperture that extends, from the second bladder 30, through the third wall 24, the space 32 and the fourth wall 26 may be formed and a flexible conduit 42 in communication, at one end, to the air release valve 44 and, on the other end, to the second air bladder 30, inserted therein. Of course, in the "staggered" configuration of the invention whereby the second and third walls 22 and 24 separate at a point, along the lower part, below the point where the third and fourth walls 24 and 26 separate, the conduit 42 may be positioned to extend under the space 32.

As best shown in FIG. 1, the space 32 may be used to temporarily store the pump bulb 34 of the air supply system. To do so, an aperture defined by an interior edge surface 54 is formed in the fourth wall 26. The aperture provides access to the space 32 between the third and fourth walls 24 and 26. Of course, the space 32 should be sized to receive the pump bulb 34 therein, the access aperture should be sized to enable the pump bulb 34 to readily pass therethrough and the flexible conduit 36 should have a length to allow the repositioning of the pump bulb between the "in use" position shown in FIG. 2 and the "stored" position shown in FIG. 1.

When not in use, the protective cover 18 is preferably stored with both the first and second air chambers 28 and 30 in a fully deflated condition and the pump bulb 34 inserted into the space 32. In use, the protective cover 18 (with fully deflated air chambers 28 and 30) is first placed over the golf clubs 11 and part of the sidewall 10*a* of the golf club bag 10. The protective cover 18 is then tightly secured to the golf club bag 10 in the manner more fully described below. The pump bulb 34 is then removed and then repeatedly compressed to begin filling the first air chamber 28 with air. Air is supplied to the first air chamber 28 until filled. As the first air chamber 28 will be relatively incompressible when filled with air, the first air chamber will tend to deflect any sharp blows thereto which, absent the incompressible nature of the first air chamber 18 would have the potential to nick, mar or otherwise damage the golf club 11. Similarly, the first air chamber 18 will act to deflect the golf club 11 whenever sudden movement of the golf bag 10 would cause the golf club 11 to strike against the protective cover 18 and, in the event that a hard surface was adjacent to the exterior side surface of the protective cover 18, again have the potential to damage the golf club 11.

As the quantity of air held within the first air chamber 18 provides a protective cushion for the golf clubs 11, an important feature of the invention is that no air is lost if an excess pressure condition suddenly occurs within the first air chamber 18. Specifically, whenever an excess pressure condition arises within the first air chamber 18, the pressure relief valve 40 opens to enable a flow of air out of the first air chamber 18 and into the second air chamber 20. The flow of air between the air chambers 18, 20 continues until the excess pressure condition in the first air chamber 18 is relieved. The pressure relief valve will then close, thereby trapping, in the second air chamber 20, a portion of the quantity of air originally held in the first air chamber 18. While, once the excess pressure condition is relieved, the air pressure within the first air chamber 18 will typically be somewhat lower than its air pressure when in a fully inflated condition, thereby reducing the protective capability of the first air chamber 18, it is contemplated that the loss in protective capability by the first air chamber 18 will be compensated for by an increase in the protective capability of the second air chamber 20 which occurs due to the increased air pressure within the second air chamber 20 produced by the portion of the quantity of air which flows into the second air chamber 20. As a result, conditions which, in conventionally configured inflatable protective covers, would likely result in the loss of some or all of the protective capability of the cover, would not cause a corresponding loss of protective capability in the protective cover subject of the present invention.

Finally, the frictional engagement between the inner side surface 20*b* of the first wall 20 of the protective cover 18 and the outer side surface 10*c* of the sidewall 10*a* of the golf club bag 10 is enhanced by an attachment member 46 and securing strap 48 provided along the lower portion of the protective cover 18. The attachment member 36 is a strip of adhesive material, attached to the outer side surface 26*c* of the fourth wall 26 along the entire circumference thereof. For example, the attachment member 46 may have a layer of pile material 50 formed on an exterior side surface 46*c* thereof. The securing strap 48 is fixedly attached on a first end (not shown) to the attachment member 46 in a suitable fashion, for example, by a threaded attachment, and has a second free end 48*a*. A layer 52 of adhesive material, for example, a layer of hook material, is formed along an inner side surface 48*b* of the securing strap 48. By firmly pulling the securing strap 48 by its free end and then attaching the securing strap 48 to the attachment member 46, the frictional engagement between the first wall 20 of the protective cover 18 and the sidewall 10*a* of the golf club bag 10 may be tightened until the protective cove 18 is tightly secured to the golf club bag 10.

Although an illustrative embodiment of the invention has been shown and described, other modifications, changes, and substitutions are intended in the foregoing disclosure. Accordingly, it is appropriate that the appended claims be construed broadly and in a manner consistent with the scope of the invention.

What is claimed is:

1. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder and a second bladder; and a pressure relief valve, said first bladder in communication with said second bladder via said pressure relief valve;

wherein said first bladder, when inflated, protects said at least one golf club in said golf club bag from outside forces;

said pressure relief valve permitting a flow of air from said first bladder to said second bladder to relieve an excess pressure condition in said first bladder only when the air pressure in said first bladder exceeds a pre-selected threshold value.

2. The protective cover of claim 1 wherein said first bladder further comprises an inlet/outlet valve in communication with the interior of said first bladder and further comprising:

an air supply system, coupled to inlet/outlet valve, for providing air to the interior of said first bladder.

3. The protective cover of claim 2 wherein said air supply system further comprises:

a pump bulb; and a flexible tube coupling said pump bulb and said inlet/outlet valve.

4. The protective cover of claim 2 wherein said attachment member further comprises a securing strap coupled to said attachment member, said securing strap biasing said inflatable body portion into frictional engagement with said golf club bag.

5. The protective cover of claim 4 wherein an interior side surface of said securing strap and an exterior side surface of said attachment member have complementary hook and pile surfaces for removable engagement therebetween.

6. The protective cover of claim 1 wherein said first bladder is an inner bladder and said second bladder is an outer bladder, said outer bladder generally coextensive with said inner bladder.

7. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder, a second bladder, and an inlet/outlet valve in communication with the interior of said first bladder;

a pressure relief valve, said first bladder in communication with said second bladder via said pressure relief valve;

an air supply system, coupled to inlet/outlet valve, for providing air to the interior of said first bladder, said air supply system comprised of a pump bulb and a flexible tube coupling said pump bulb and said inlet/outlet valve; and a primary air release valve for providing an exit path for air in the interior of said first bladder when actuated, said primary air release valve coupled to said air supply system;

wherein said first bladder, when inflated, protects said at least one golf club in said golf club bag from outside forces and wherein an excess pressure condition in said first bladder causes a flow of air into said second bladder to relieve said excess pressure within said first bladder without reducing the total amount of air maintained within said inflatable body portion.

8. The protective cover of claim 7 wherein said primary air release valve is coupled to said flexible tube.

9. The protective cover of claim 7 and further comprising:

a secondary air release valve for providing an exit path for air in said second bladder when actuated, said secondary air release valve in communication with the interior of said second bladder.

10. The protective cover of claim 7 wherein said first bladder is an inner bladder and said second bladder is an outer bladder, said outer bladder generally coextensive with said inner bladder.

11. A protective cover configured for attachment to a golf club bag having a golf club receiving opening formed along a top side thereof, comprising:

a first flexible wall having a lower part and an upper part, said upper part of said first wall covering said golf club receiving opening when said lower part of said first wall frictionally engages said golf club bag;

a second flexible wall having a lower part sealingly attached to said lower part of said first wall and an upper part which overlays said upper part of said first wall to form a first air bladder therebetween;

an air supply system, in communication with said first air bladder, for supplying a quantity of air to said protective cover by inflating said first air bladder with said quantity of air;

a third flexible wall having a lower part sealingly attached to said lower part of said second wall and an upper part which overlays said upper part of said second wall to form a second air bladder therebetween; and a pressure relief valve, said second air bladder in communication with said first air bladder via said pressure relief valve; wherein an excess pressure condition in said first air bladder is relieved by a flow of air, through said pressure relief valve, into said second air bladder;

said excess pressure condition in said first air bladder being relieved without removing a portion of said first quantity of air from said protective cover by removing said portion of said first quantity of air from said first air bladder and transferring said portion of said first quantity of air to said second bladder.

12. The protective cover of claim 11 wherein said air supply system further comprises:

an air conduit having a first end in communication with said first air bladder and a second end; and an air pump having an air outlet in communication with said second end of said air conduit.

13. The protective cover of claim 12 wherein said air pump is a pump bulb.

14. The protective cover of claim 11 and further comprising:

a fourth flexible wall having a lower part attached to said lower part of said third wall and an upper part which overlays said upper part of said second wall to form a storage space therebetween;

said fourth wall having an aperture formed therein;

wherein said storage space is accessible through said aperture.

15. The protective cover of claim 14 wherein said air supply system further comprises:

an air conduit having a first end in communication with said first air bladder and a second end; and an air pump having an air outlet in communication with said second end of said air conduit;

wherein said air pump is storable in said storage space.

16. The protective cover of claim 15 wherein said air pump is a pump bulb.

17. The protective cover of claim 15 wherein said air supply system further comprises:

a primary air release valve in communication with said first bladder, said primary air release valve providing, when actuated, an exit path for said quantity of air held by said first bladder.

18. The protective cover of claim 17 and further comprising:

a secondary air release valve in communication with said second bladder, said secondary air release valve providing, when actuated, an exit path for said portion of said quantity of air removed from said first bladder and transferred to said second bladder.

19. For a golf club bag having a side surface which defines an interior space for receiving at least one golf club and a too surface which defines an opening from which a portion of each one of said at least one golf club projects, a protective covers comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder, a second bladder, and an inlet/outlet valve in communication with the interior of said first bladder;

a pressure relief valve, said first bladder in communication with said second bladder via said pressure relief valve;

an air supply system, coupled to inlet/outlet valve, for providing air to the interior of said first bladder, said air supply system comprised of a pump bulb and a flexible tube coupling said pump bulb and said inlet/outlet valve; and an outer cover member;

said outer cover member secured to said inflatable body portion and said attachment member;

said outer cover member covering said inflatable body portion and having an aperture formed therein;

wherein said first bladder, when inflated, protects said at least one golf club in said golf club bag from outside forces and wherein an excess pressure condition in said first bladder causes a flow of air into said second bladder to relieve said excess pressure within said first bladder without reducing the total amount of air maintained within said inflatable body portion; and wherein said pump bulb may be positioned between an outer side surface of said inflatable body portion and an inner side surface of outer cover member by inserting said pump bulb through said aperture.

20. The protective cover of claim 19 wherein said first bladder is an inner bladder and said second bladder is an outer bladder, said outer bladder generally coextensive with said inner bladder.

21. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder, a second bladder and an inlet/outlet valve in communication with the interior of said first bladder;

an air supply system, coupled to inlet/outlet valve, for providing air to the interior of aid first bladder;

a primary air release valve for providing an exit path for air in the interior of said first bladder when actuated, said primary air release valve coupled to said air supply system;

a pressure relief valve, said first bladder in communication with said second bladder via said pressure relief valve;

wherein said first bladder, when inflated, protects said at least one golf club in said golf club bag from outside forces and wherein an excess pressure condition in said first bladder causes a flow of air into said second bladder to relieve said excess pressure within said first bladder without reducing the total amount of air maintained within said inflatable body portion.

22. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder, a second bladder and an inlet/outlet valve in communication with the interior of said first bladder;

an air supply system, coupled to inlet/outlet valve, for providing air to the interior of said first bladder; and a primary air release valve for providing an exit path for air in the interior of said first bladder when actuated, said primary air release valve coupled to said air supply system;

wherein said air supply system further comprises:

a pump bulb; and a flexible tube coupling said pump bulb and said inlet/outlet valve.

23. The protective cover of claim 22 and further comprising:

an outer cover member;

said outer cover member secured to said inflatable body portion and said attachment member;

said outer cover member covering said inflatable body portion and having an aperture formed therein;

wherein said pump bulb may be positioned between an outer side surface of said inflatable body portion and an inner side surface of outer cover member by inserting said pump bulb through said aperture.

24. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof said attachment member configured for basing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder, a second bladder and an inlet/outlet valve in communication with the interior of said first bladder;

an air supply system, coupled to inlet/outlet valve, for providing air to the interior of said first bladder;

a primary air release valve for providing an exit path for air in the interior of said first bladder when actuated, said primary air release valve coupled to said air supply system; and a secondary air release valve for providing an exit path for air in said second bladder when actuated, said secondary air release valve in communication with the interior of said second bladder.

25. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder, a second bladder and an inlet/outlet valve in communication with the interior of said first bladder;

an air supply system, coupled to inlet/outlet valve, for providing air to the interior of said first bladder;

a primary air release valve for providing an exit path for air in the interior of said first bladder when actuated, said primary air release valve coupled to said air supply system;

wherein said first bladder is an inner bladder which covers said opening and said projecting portion of each one of said golf clubs and said second bladder is an outer bladder which covers said inner bladder.

26. For a golf club bag having a side surface which defines an interior space for receiving at least one golf club and a top surface which defines an opening from which a portion of each one of said at least one golf club projects, a protective cover, comprising:

an inflatable body portion having an upper part and a lower part which terminates in a peripheral edge;

an attachment member secured to said inflatable body portion along said lower part thereof, said attachment member configured for biasing said inflatable body portion into frictional engagement with said side surface of said golf club bag, said inflatable body portion covering said opening and said projecting portion of each one of said golf clubs when said attachment member biases said inflatable body portion into frictional engagement with said side surface of said golf club bag;

said inflatable body portion including a first bladder and a second bladder;

an inlet/outlet valve in communication with the interior of said first bladder;

an air supply system, coupled to inlet/outlet valve, for providing air to the interior of said first bladder, said air supply system comprising a pump bulb and a flexible tube coupling said pump bulb and said inlet/outlet valve; and an outer cover member;

said outer cover member secured to said inflatable body portion and said attachment member;

said outer cover member covering said inflatable body portion and having an aperture formed therein;

wherein said pump bulb may be positioned between an outer side surface of said inflatable body portion and an inner side surface of outer cover member by inserting said pump bulb through said aperture.

27. The protective cover of claim 26 and further comprising:

a pressure relief valve, said first bladder in communication with said second bladder via said pressure relief valve;

wherein said first bladder, when inflated, protects said at least one golf club in said golf club bag from outside forces and wherein an excess pressure condition in said first bladder causes a flow of air into said second bladder to relieve said excess pressure within said first bladder without reducing the total amount of air maintained within said inflatable body portion.

28. The protective cover of claim 26 wherein said first bladder is an inner bladder which covers said opening and said projecting portion of each one of said golf clubs and said second bladder is an outer bladder which covers said inner bladder.

29. A golf club transportation and protection system, comprising:

a golf club bag having a sidewall which defines an interior space for receiving at least one golf club and a top surface which defines an opening from which a portion of each one of said at least one golf club projects;

a protective cover which provides a protective cushion for said at least one golf club by retaining a quantity of air therein, said protective cover attached to said sidewall of said golf club bag and having first and second air bladder portions, said protective cover covering said opening and said projecting portion of each one of said golf clubs when said protective cover frictionally engages said sidewall of said golf club bag;

an air supply system, in communication with said first air bladder, for supplying said quantity of air to said protective cover by inflating said first air bladder with said quantity of air; and a pressure relief valve, said second air bladder in communication with said first air bladder via said pressure relief valve;

wherein an excess pressure condition in said first air bladder is relieved without removing a portion of said first quantity of air from said protective cover by a flow of a portion of said first quantity of air, through said pressure relief valve, into said second air bladder;

said pressure relief valve permitting a flow of air from said first bladder to said second bladder to relieve an excess pressure condition in said first bladder only when the air pressure in said first bladder exceeds a pre-selected threshold value.

* * * * *